US008943825B2

(12) United States Patent
Magni et al.

(10) Patent No.: US 8,943,825 B2
(45) Date of Patent: Feb. 3, 2015

(54) HELMHOLTZ DAMPER FOR A COMBUSTOR OF A GAS TURBINE AND A METHOD FOR INSTALLING THE HELMHOLTZ DAMPER

(75) Inventors: Fulvio Magni, Nussbaumen (CH); Martin Andrea Von Planta, Oetwil a.d. Limmat (CH); Frank Grimm, Baden (CH); Dariusz Nowak, Untersiggenthal (CH); Mischa Schaerer, Staufen (CH)

(73) Assignee: Alstom Technology Ltd., Baden (CH)

( * ) Notice: Subject to any disclaimer, the term of this patent is extended or adjusted under 35 U.S.C. 154(b) by 858 days.

(21) Appl. No.: 13/015,640

(22) Filed: Jan. 28, 2011

(65) Prior Publication Data

US 2011/0179796 A1 Jul. 28, 2011

(30) Foreign Application Priority Data

Jan. 28, 2010 (CH) ..... 0101/10

(51) Int. Cl.
*F23R 3/00* (2006.01)

(52) U.S. Cl.
CPC ..... *F23R 3/00* (2013.01); *F23M 99/005* (2013.01); *F23C 2900/07002* (2013.01); *F23D 2210/00* (2013.01); *F23R 2900/00016* (2013.01); *F23R 2900/03342* (2013.01)
USPC ..... 60/725; 60/752; 431/114

(58) Field of Classification Search
CPC ..... F23R 2900/00014; F23R 3/00; F23R 2900/00016; F23R 2900/03342; F23M 99/005; F23C 2900/07002; F23D 2210/00
USPC ..... 60/725, 752–760; 431/114
See application file for complete search history.

(56) References Cited

U.S. PATENT DOCUMENTS 4,932,861 A 6/1990 Keller
5,373,695 A * 12/1994 Aigner et al. ..... 60/804

(Continued)

FOREIGN PATENT DOCUMENTS

CN 101263343 A 9/2008
DE 102005062284 A1 1/2008

(Continued)

OTHER PUBLICATIONS

Search Report for Swiss Application No. CH 1012010, mailed on May 12, 2010.

(Continued)

*Primary Examiner* — William H Rodriguez
*Assistant Examiner* — Carlos A Rivera
(74) *Attorney, Agent, or Firm* — Buchanan Ingersoll & Rooney PC

(57) ABSTRACT

A Helmholtz damper for a combustor of a gas turbine includes first and second damping volumes. The combustor has a combustion chamber disposed in a housing and closed off by a front plate at which a plurality of burners are exchangeably fastened. The burners are supplied with fuel via fuel lances which extend from outside the housing through a bushing of the housing to the associated burner. The first damping volume has a first end and a second end, the first end of the first damping volume being configured to attach a connecting passage extending to a front panel such that the Helmholtz damper is connectable with the front plate of the combustion chamber in place of one of the burners. The second damping volume has a first end and a second end and is arranged in series with the first damping volume along an axis of the Helmholtz damper with the first end of the second damping volume being detachably connected to the second end of the first damping volume so as to form a combined larger damping volume. The second end of the second damping volume is configured to attach a connecting tube extending from the second damping volume and through the bushing in place of a respective one of the fuel lances.

7 Claims, 4 Drawing Sheets

(56) References Cited

U.S. PATENT DOCUMENTS

| | | | | |
|---|---|---|---|---|
| 6,546,729 | B2 * | 4/2003 | Hellat et al. | 60/725 |
| 7,331,182 | B2 * | 2/2008 | Graf et al. | 60/725 |
| 7,413,053 | B2 * | 8/2008 | Wasif et al. | 181/293 |
| 7,448,215 | B2 * | 11/2008 | Macquisten et al. | 60/725 |
| 2002/0100281 | A1 | 8/2002 | Hellat | |
| 2005/0103018 | A1 | 5/2005 | Graf | |
| 2009/0282831 | A1 | 11/2009 | Eroglu | |
| 2009/0293481 | A1 | 12/2009 | Bethke | |
| 2010/0011769 | A1 * | 1/2010 | Gambacorta et al. | 60/725 |

FOREIGN PATENT DOCUMENTS

| | | | |
|---|---|---|---|
| EP | 0321809 | | 6/1989 |
| EP | 2119964 | A1 | 11/2009 |
| WO | WO 03060381 | A1 | 7/2003 |

OTHER PUBLICATIONS

First Office Action issued on Aug. 19, 2014, by the State Intellectual Property Office of the People's Republic of China in Chinese Patent Application No. 201110037343.1, and an English translation of the Office Action. (16 pages).

* cited by examiner

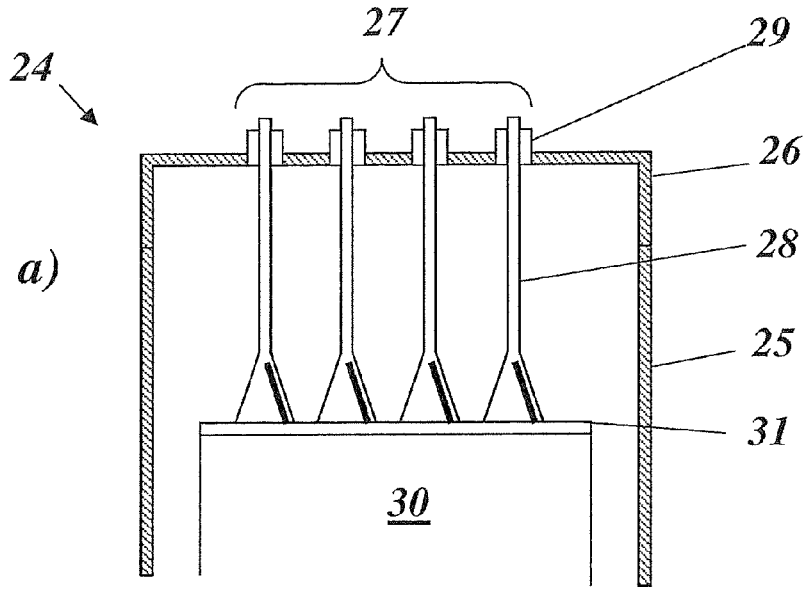
Fig.5
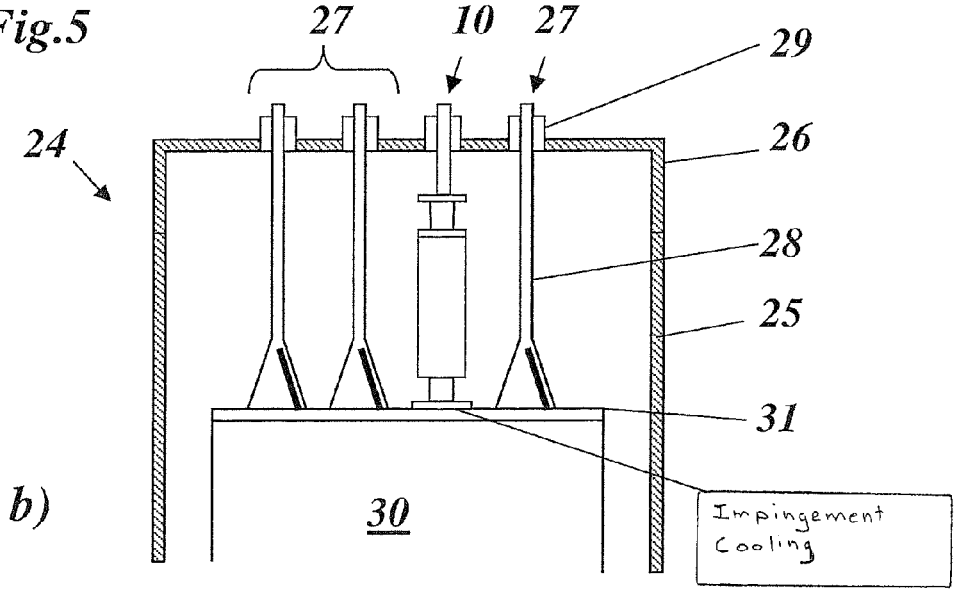

HELMHOLTZ DAMPER FOR A COMBUSTOR OF A GAS TURBINE AND A METHOD FOR INSTALLING THE HELMHOLTZ DAMPER

CROSS-REFERENCE TO PRIOR APPLICATIONS

Priority is claimed to Swiss Application No. CH 00101/10, filed Jan. 28, 2010, the entire disclosure of which is hereby incorporated by reference herein.

FIELD

The present invention relates to the field of gas turbine technology. It refers to a Helmholtz damper for installing in the combustor of a gas turbine, and also to a method for installing such a Helmholtz damper.

BACKGROUND

During the combusting of liquid or gaseous fuels in the combustor of a gas turbine, the so-called lean premix combustion has been established. In this, the fuel and the combustion air are premixed as evenly as possible and then directed into the combustor. For ecological reasons, attention is paid to a low flame temperature which is achieved as a result of a large surplus of air ("lean premix"). In this way, the development of nitrogen oxide can be kept low. Corresponding premix burners, which are also known as EV burners (EV stands for Environmental Vortex), are described for example in EP 321 809. Burners of this type are used in annular combustors or silo combustors. The schematic construction of silo combustors with EV burners is reproduced for example in FIG. 2 of DE 10 2005 062 284.

In combustors of this type, as a result of a mutual build-up of thermal and acoustic disturbances, thermoacoustic vibrations occur, as is known, which are not only loud but can adopt large vibration amplitudes in such a way that the gas turbine borders on the limit of its mechanical loadability and permanent damage may occur. In order to prevent it, in today's combustors provision is made for so-called Helmholtz dampers with which the possible vibration amplitudes in the combustor are lessened or even eliminated.

Since the thermoacoustic vibrations which occur in a combustor are influenced in frequency and amplitude by the extremely varied geometric and operating parameters of the combustor, in the case of a new combustor the anticipated vibrations can only be very unsatisfactorily predicted. It can be, therefore, that the Helmholtz dampers which are used on the combustor are initially not optimally matched to the vibrations which actually occur in the combustor.

It is discussed in the aforesaid DE 10 2005 062 284, in the case of an annular combustor or silo combustor, to connect correspondingly designed Helmholtz dampers to the combustion chamber of the combustor in place of individual EV burners. The individual Helmholtz dampers in this case may comprise a plurality of damping volumes connected in series. Furthermore, provision may be made for an adjusting mechanism with which at least one of the damping volumes can be steplessly altered from outside. For the operation of the adjusting mechanism, provision is made for a piston rod (37 in FIG. 2 of DE 10 2005 062 284), for which a suitable bushing has to be arranged in the associated housing opening (26 in FIG. 2). Also, apart from the adjusting mechanism, the damping volume cannot be altered from its basic structure, which impairs the flexibility of the Helmholtz dampers in use.

An annular combustor for a gas turbine, which is equipped with EV burners, is known from WO 03/060381. In this case, a Helmholtz damper, which comprises a constant and a variable volume, is installed between adjacent burners. For adjustment of the variable volume, provision is made for a special closable access in the turbine housing, through which the adjustment can be carried out by means of an insertable tool.

SUMMARY

In an embodiment, the present invention provides a Helmholtz damper for a combustor of a gas turbine. The combustor has a combustion chamber disposed in a housing and closed off by a front plate at which a plurality of burners are exchangeably fastened. The burners are supplied with fuel via fuel lances which extend from outside the housing through a bushing of the housing to the associated burner. A first damping volume of the Helmholtz damper has a first end and a second end, the first end of the first damping volume being configured to attach a connecting passage extending to a front panel such that the Helmholtz damper is connectable with the front plate of the combustion chamber in place of one of the burners. A second damping volume of the Helmholtz damper has a first end and a second end and is arranged in series with the first damping volume along an axis of the Helmholtz damper with the first end of the second damping volume being detachably connected to the second end of the first damping volume so as to form a combined larger damping volume. The second end of the second damping volume is configured to attach a connecting tube extending from the second damping volume and through the bushing in place of a respective one of the fuel lances.

BRIEF DESCRIPTION OF THE DRAWINGS

The present invention will be described in even greater detail below based on the exemplary figures, which are not to scale. The invention is not limited to the exemplary embodiments. Other features and advantages of various embodiments of the present invention will become apparent by reading the following detailed description with reference to the attached drawings which illustrate the following:

FIG. 5 shows in section the upper part of a silo combustor of a gas turbine with a multiplicity of so-called EV burners (FIG. 5*a*), of which one is replaced by a Helmholtz damper according to FIG. 2 (FIG. 5*b*)

DETAILED DESCRIPTION

Figure 1:
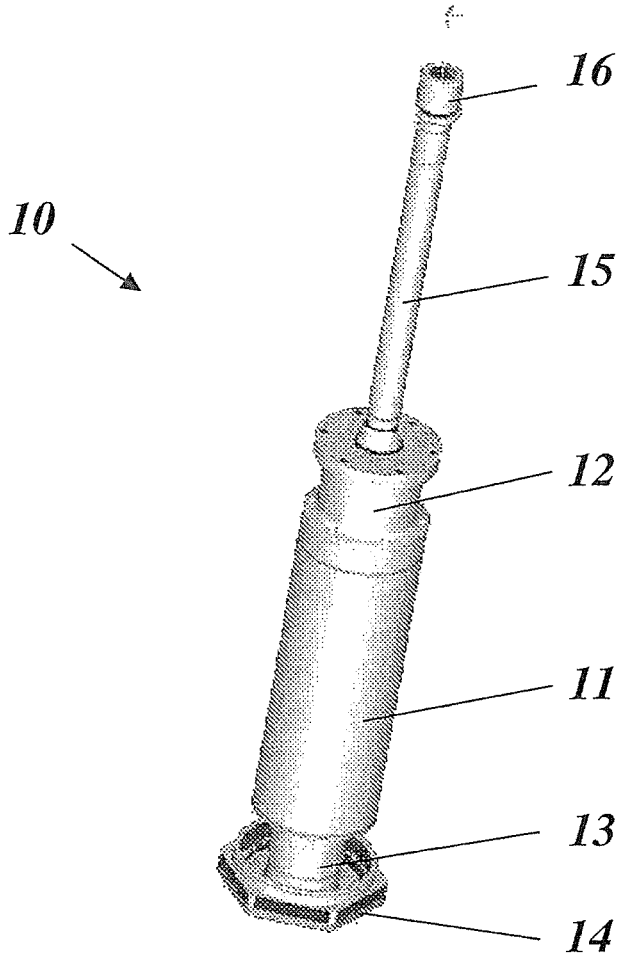
FIG. 1 shows in a perspective external view a Helmholtz damper according to an exemplary embodiment of the invention.

It has been determined that the Helmholtz dampers of the prior art described above are therefore either not flexible enough in application and adjustment to the respective combustor, or only by taking special precautionary measures can they be integrated in existing combustors and adjusted from outside the combustor.

It is therefore an aspect of the invention on the one hand to improve a Helmholtz damper of the type referred to in the introduction so that it can be used in a significantly more flexible manner, and so that it can be installed in an existing combustor without additional outlay, and on the other hand to disclose a method for installing such a Helmholtz damper.

Advantageously, the Helmholtz damper according to an embodiment of the present invention comprises a first damping volume and a second damping volume which are arranged in series along an axis and are detachably interconnected, forming a combined larger damping volume, in that at the end of the first damping volume which lies opposite the second damping volume, arrangement is made for a connecting passage which extends from the first damping volume and ends in a front panel in such a way that the Helmholtz damper can be fastened in the front plate in place of a burner, and in that at the end of the second damping volume which lies opposite the first damping volume, arrangement is made for a connecting tube which extends from the second damping volume and can be guided outwards through a bushing in the housing in place of a fuel lance. As a result of this, it is possible without greater outlay to install the Helmholtz damper in the combustor in place of a burner and its fuel lance. Thus, all places on the combustor which are occupied by a burner are available in principle for the installation. At the same time, an adjusting mechanism, with which the damping volume can be continuously altered, can be operated from outside by means of the connecting tube.

One development according to an embodiment of the present invention is that the second damping volume is connected via two flange connections to the connecting tube and to the first damping volume. As a result of this, it is possible in a simple manner to alter the second damping volume by a corresponding component with another volume being installed. As a result of this, flexibility in use is increased still further.

The exchanging of the second damping volume is particularly simple if the two flange connections are bolted together by means of common threaded bolts which extend through the two flange connections.

Another development according to an embodiment of the present invention is that the two damping volumes are cylindrically formed and arranged concentrically to the axis.

In particular, the second damping volume has a smaller inside diameter and a shorter axial length than the first damping volume.

Preferably, the inside diameter of the second damping volume can be altered in steps by exchange of the corresponding component with constant axial length.

A further development according to an embodiment of the present invention is that an adjusting device, which can be operated from outside through the connecting tube and with which the second damping volume can be continuously altered, is arranged in the second damping volume.

So that the Helmholtz damper withstands the thermal loads, it is advantageous for the front panel to be cooled, especially impingement cooled.

The method according to an embodiment of the present invention for installing a Helmholtz damper according to the invention in a combustor of a gas turbine, which combustor comprises a combustion chamber which is arranged inside a housing, is closed off at the top by means of a front plate and in which a multiplicity of burners are fastened in an exchangeable manner, wherein the burners are supplied with fuel via fuel lances which in each case extend from outside through a bushing in the housing to the associated burner, advantageously provides that one of the burners is removed and the Helmholtz damper is installed in its place, wherein the connecting tube is guided outwards through the freed bushing in the housing in place of a fuel lance.

Figure 2:
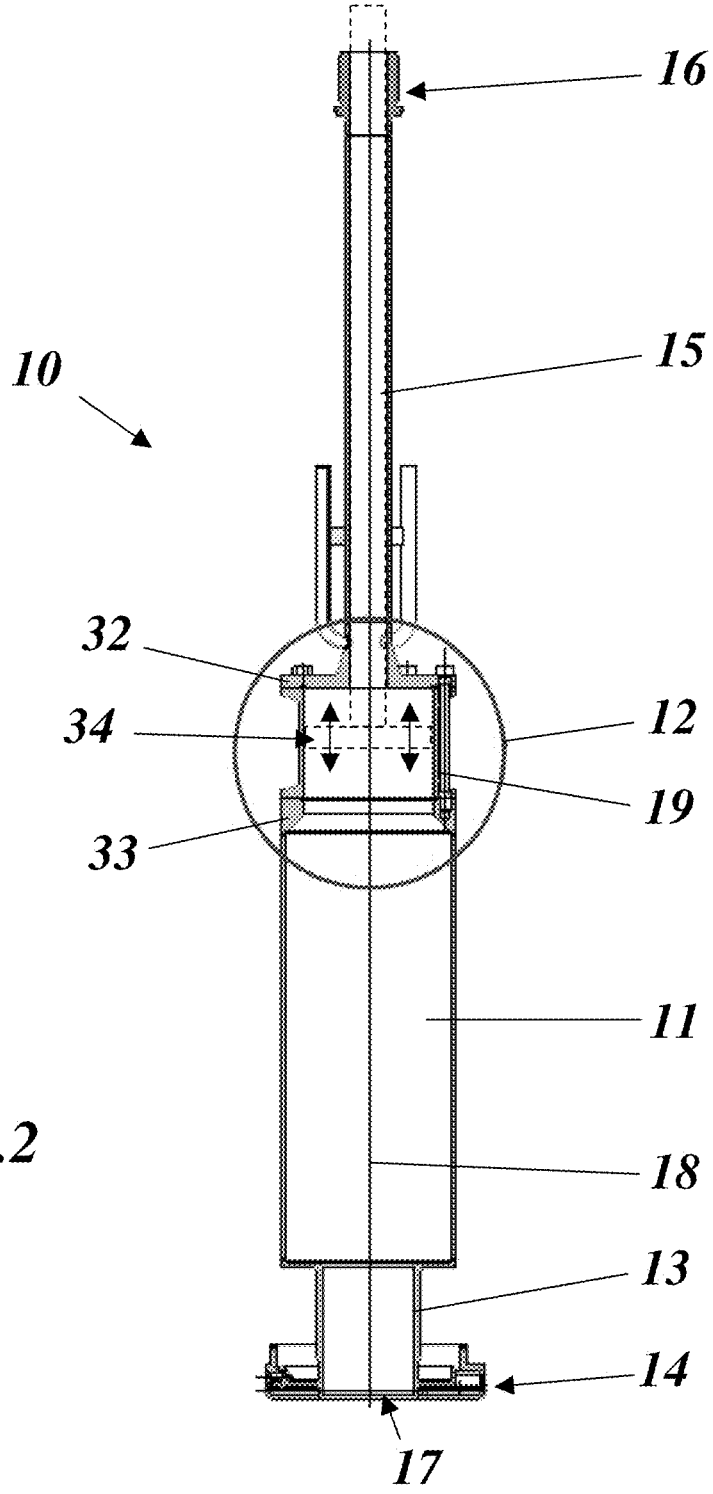
FIG. 2 shows the longitudinal section through the Helmholtz damper from FIG. 1.

In FIGS. 1 and 2, in a perspective external view and in longitudinal section respectively, a Helmholtz damper according to an exemplary embodiment of the invention is shown. The Helmholtz damper 10 which is shown comprises two damping volumes 11 and 12 which are arranged in series along an axis 18 and interconnected. The first damping volume 11 is cylindrically formed and represents the main volume of the Helmholtz damper 10. The smaller second damping volume 12, which is also cylindrically formed, is flanged to this main volume. The second damping volume 12, which in FIG. 2 is encircled for identification, as a component has the design which is reproduced in FIGS. 3 and 4 in longitudinal section and in perspective external view respectively.

The second damping volume 12 is closed off at the top by means of a flange 32 which is arranged at the bottom end of an upwards leading connecting tube 15. Via the connecting tube 15, which is provided with a connection 16 at the top end, the second damping volume 12 is accessible from the top. In particular, the operating rod of an adjusting device 34 (drawn-in with broken lines in FIG. 2), with which the volume of the second damping volume 12 can be continuously adjusted (double arrows in FIG. 2), can be guided through the connecting tube 15.

Figure 4:
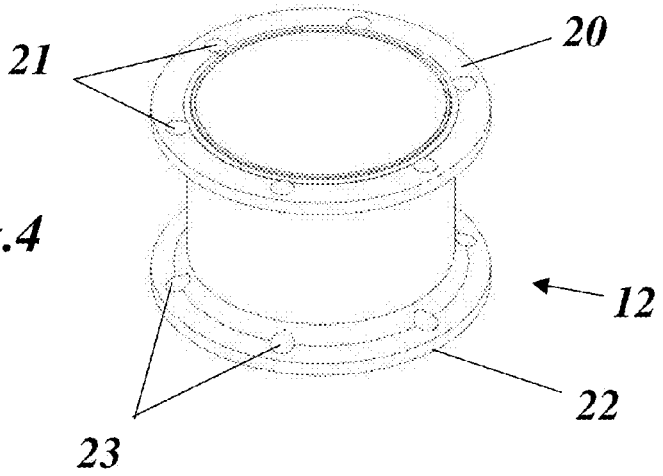
FIG. 4 shows a perspective external view of an exchangeable damping volume according to FIG. 3.

The second damping volume 12, according to FIG. 4, comprises a hollow-cylindrical section which at both ends is provided with a circular flange 20 or 22 in each case. A plurality of fastening holes 21 or 23, which align with each other, are arranged in the flanges 20, 22, in a distributed manner on the circumference. In this way, by means of inserted threaded bolts 19 the second damping volume 12 can be flanged very simply at the same time at the bottom on the first damping volume 11, which has corresponding threaded holes, and can be closed off at the top by the flange 32.

Figure 3:
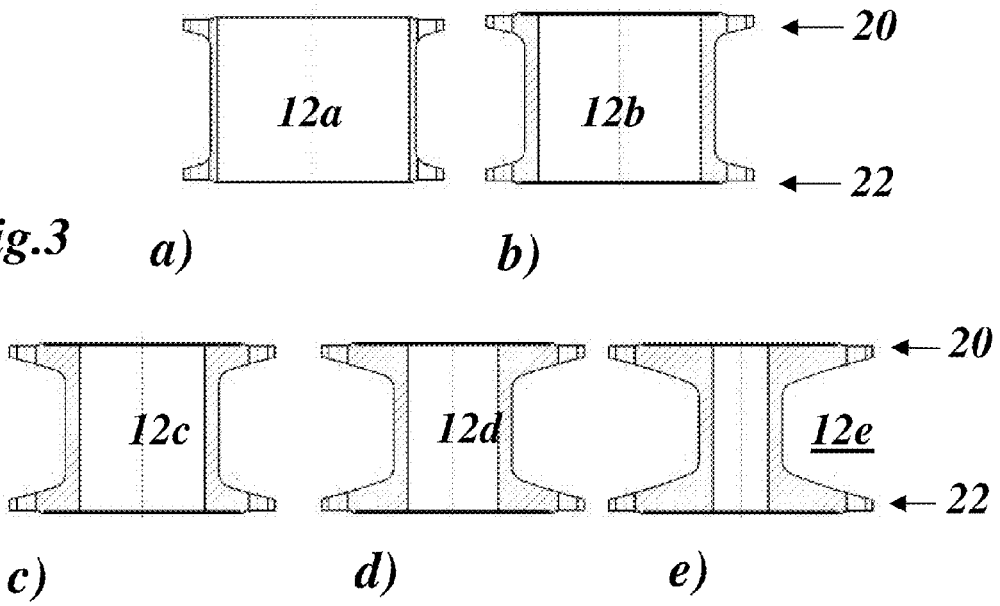
FIG. 3 shows in different sub-figures (FIGS. 3*a* to 3*e*) in longitudinal section a plurality of exchangeable damping volumes of different size which differ in their inside diameter.

As a result of the easy exchangeability of the second damping volume 12, the second damping volume 12, in addition to or alternatively to a continuous adjustment by means of an adjusting device 34, can be altered in steps by installing damping volumes 12*a*-12*e*, according to FIG. 3, with the same axial length but inside diameters of different size. For this purpose, only the threaded bolts 19 have to be detached, the volumes exchanged, and the threaded bolts 19 screwed in again.

At the bottom end of the first damping volume 11, a connecting passage 13 in the form of a pipe section with a connecting opening 17 is attached, the damping volumes 11, 12 being acoustically coupled to the combustor (30 in FIG. 5) via said connecting passage. A front panel 14 is fastened at the bottom end of the connecting passage 13 and has the same lateral dimensions as a burner (EV burner 27 in FIG. 5) so that the gap which is created in the front plate 31 of the combustor 24 when a burner 27 is removed is closed off by means of the Helmholtz damper 10. The front panel 14 is preferably impingement cooled with cooling air which is guided forwards in order to dissipate the heat which is introduced from the combustion chamber 30.

FIG. 5*a* shows as an example, in a greatly simplified manner, the upper region of a silo combustor 24, the vertical cylindrical housing 25 of which is closed off at the top by means of a cover 26. A plurality of EV burners 27 of the same type, with the characteristic lower double-cone section, are accommodated in a distributed manner in the cover 26. The double cones lead directly into the combustion chamber 30. From outside the silo combustor 24, fuel is introduced into the double cone from outside via a fuel lance 28 in the case of each EV burner 27. For passage of the fuel lance into the combustor 24, a bushing 29 is provided in each case. The connecting tube 15 with the top connection 16 of the Helmholtz damper 10 is now formed just like the corresponding fuel lance 28 so that when replacing a burner 27 by a Helmholtz damper 10 the connecting tube 15 at the same time can also occupy the position of the fuel lance 28 without further modifications (see FIG. 5*b*).

An embodiment of the present invention can be summarized as follows:

The new Helmholtz damper can be used in place of an EV burner. Free burner positions are used.

The Helmholtz damper provides two adjusting devices. A tube, which is accessible from outside, allows the damping volume to be altered. A second mechanism allows the volume to be altered still further. In one part of the damper, cylinders with different diameters are installed for this purpose.

An impingement cooled front plate enables the Helmholtz damper to be directly exposed to the high temperatures at this point of the combustor.

The Helmholtz damper is directly accessible from the outside and so can be adjusted in frequency without disassembly or removing any covers.

While the invention has been particularly shown and described with reference to preferred embodiments thereof, it will be understood by those skilled in the art that various changes in form and details may be made therein without departing from the spirit and scope of the invention.

LIST OF DESIGNATIONS

10 Helmholtz damper
11, 12 Damping volume
13 Connecting passage
14 Front panel
15 Connecting tube
16 Connection
17 Connecting opening
18 Axis
19 Threaded bolt
20, 22, 32, 33 Flange
21, 23 Fastening hole
24 Combustor (silo combustor)
25 Housing
26 Cover
27 Burner (EV burner)
28 Fuel lance
29 Bushing
30 Combustion chamber
31 Front plate
34 Adjusting device

The invention claimed is:

1. A Helmholtz damper for a combustor of a gas turbine having a combustion chamber disposed in a housing and closed off by a front plate at which a plurality of burners are exchangeably fastened, the plurality of burners being supplied with fuel via fuel lances which extend from outside the housing through a bushing of the housing to an associated burner, the Helmholtz damper comprising:

a first damping volume having a first end and a second end, the first end of the first damping volume being configured to attach a connecting passage extending to a front panel such that the Helmholtz damper is connectable with the front plate of the combustion chamber in place of one of the plurality of burners;

a second damping volume having a first end and a second end, the second damping volume being arranged in series with the first damping volume along an axis of the Helmholtz damper with the first end of the second damping volume being detachably connected to the second end of the first damping volume so as to form a combined larger damping volume, the second end of the second damping volume being configured to attach a connecting tube extending from the second damping volume and through the bushing in place of a respective one of the fuel lances wherein the first and second damping volumes are cylindrical formed and disposed concentrically with respect to each other along the axis;

wherein the second damping volume includes at least two flange connections at each of the first end and the second end configured to respectively attach to the first damping volume and the connecting tube; and wherein an inside diameter of the second damping volume is configured to be adjustable in steps by detaching the at least two flange connections and exchanging the second damping volume with a corresponding component having equal axial length and different inside diameter.

2. The Helmholtz damper according to claim 1, wherein the at least two flange connections are bolted together at the first and second ends of the second damping volume by common threaded bolts extending through the at least two flange connections.

3. The Helmholtz damper according to claim 1, wherein the second damping volume has a smaller inside diameter and a shorter axial length than the first damping volume.

4. The Helmholtz damper according to claim 1, further comprising an adjusting device configured to extend through the connecting tube and into the second damping volume, the adjusting device being operable from outside the housing so as to continuously adjust the second damping volume.

5. The Helmholtz damper according to claim 1, wherein the front panel is cooled.

6. The Helmholtz damper according to claim 5, wherein the front panel is impingement cooled.

7. A method for installing a Helmholtz damper in a combustor of a gas turbine having a combustion chamber disposed in a housing and closed off by a front plate at which a plurality of burners are exchangeably fastened, the plurality of burners being supplied with fuel via fuel lances which extend from outside the housing through a bushing of the housing to the associated burner, the Helmholtz damper including a first damping volume having a first end and a second end, the first end of the first damping volume being configured to attach a connecting passage extending to a front panel such that the Helmholtz damper is connectable with the front plate of the combustion chamber in place of one of the plurality of burners; a second damping volume having a first end and a second end, the second damping volume being arranged in series with the first damping volume along an axis of the Helmholtz damper with the first end of the second damping volume being detachably connected to the second end of the first damping volume so as to form a combined larger damping volume, the second end of the second damping volume being configured to attach a connecting tube extending from the second damping volume and through the bushing in place of a respective one of the fuel lances; wherein the first and second damping volumes are cylindrical formed and disposed concentrically with respect to each other along the axis; and wherein an inside diameter of the second damping volume is configured to be adjustable in steps by exchanging the second damping volume with a corresponding component having equal axial length and different inside diameter, the method comprising:

removing at least one of the plurality of burners;

installing the Helmholtz damper in place of the at least one of the plurality of burners that was removed; and guiding the connecting tube of the Helmholtz damper through the bushing of the housing in place of at least one of the fuel lances associated with the at least one of the plurality of burners that was removed.

* * * * *